US010252429B2

(12) United States Patent
Sablatschan et al.

(10) Patent No.: US 10,252,429 B2
(45) Date of Patent: Apr. 9, 2019

(54) STATIONARY CUTTING BLADE FOR A HAIR CLIPPING DEVICE

(71) Applicant: KONINKLIJKE PHILIPS N.V., Eindhoven (NL)

(72) Inventors: Siegfried Sablatschan, Eindhoven (NL); Roel Alexander Rethmeier, Eindhoven (NL); Willem Maat, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 182 days.

(21) Appl. No.: 14/893,206

(22) PCT Filed: May 19, 2014

(86) PCT No.: PCT/IB2014/061525
§ 371 (c)(1),
(2) Date: Nov. 23, 2015

(87) PCT Pub. No.: WO2014/191867
PCT Pub. Date: Dec. 4, 2014

(65) Prior Publication Data

US 2016/0101530 A1 Apr. 14, 2016

(30) Foreign Application Priority Data

May 30, 2013 (EP) ..... 13169845

(51) Int. Cl.
*B26B 19/38* (2006.01)

(52) U.S. Cl.
CPC ..... *B26B 19/3846* (2013.01); *B26B 19/3893* (2013.01)

(58) Field of Classification Search
CPC .. B26B 19/02; B26B 19/3846; B26B 19/3893
USPC ..... 30/43.91, 43.92, 194–225
See application file for complete search history.

(56) References Cited

U.S. PATENT DOCUMENTS 2,199,299 A * 4/1940 Womack ..... B26B 19/066 30/225
2,790,283 A * 4/1957 Spencer ..... B24B 3/58 30/225
2,875,519 A * 3/1959 Andis ..... B26B 19/06 30/210
3,571,928 A * 3/1971 Willey ..... B26B 19/22 30/195

(Continued)

FOREIGN PATENT DOCUMENTS

DE 102006058111 A1 6/2008
EP 0652084 A1 5/1995

(Continued)

*Primary Examiner* — Jason Daniel Prone

(57) ABSTRACT

A stationary cutting blade for a hair clipping device has a base body and a coined cutting teeth. The coined cutting teeth are spaced apart from each other, arranged on a front side of the base body, and each extend parallel to a longitudinal axis of the stationary cutting blade. A thickness ratio between the thickness of the base body and the thickness of the cutting teeth is larger than 1.1. Each cutting tooth has a substantially wedge-shaped cross-section with a scissor angle and a wedge angle, where the sum of the scissor angle and the wedge angle is smaller than 70°.

15 Claims, 5 Drawing Sheets

(56) References Cited

U.S. PATENT DOCUMENTS 3,741,046 A 6/1973 Chambon
3,751,805 A * 8/1973 Grahn ..... A01G 3/053 30/220
3,797,110 A 3/1974 Michelson
3,934,340 A * 1/1976 Jones ..... A01G 3/067 30/220
3,956,824 A * 5/1976 Francis ..... A01G 3/067 30/220
3,969,819 A * 7/1976 Pepera ..... B26B 19/20 30/200
4,152,830 A * 5/1979 Meijer ..... B26B 19/06 30/195
4,221,049 A * 9/1980 Hamashima ..... B26B 19/06 30/195
4,249,307 A * 2/1981 Andis ..... B26B 19/06 30/216
4,266,341 A * 5/1981 Claassens ..... B26B 19/22 30/195
4,502,217 A * 3/1985 Schachter ..... B26B 21/16 30/82
4,563,814 A * 1/1986 Trichell ..... B26B 19/06 30/223
4,589,205 A * 5/1986 Tanahashi ..... B26B 19/044 30/43.91
4,782,592 A * 11/1988 Altamore ..... B26B 19/06 30/195
4,825,546 A * 5/1989 Araki ..... B26B 19/06 30/195
4,979,303 A * 12/1990 Han ..... B26B 19/20 30/210
5,504,997 A * 4/1996 Lee ..... B26B 19/02 30/43.92
5,581,891 A * 12/1996 Wheeler ..... A01G 3/053 30/216
5,802,721 A 9/1998 Wain
5,933,964 A * 8/1999 Altamore ..... B26B 19/06 30/195
6,073,350 A * 6/2000 Elston ..... B26B 19/06 30/216
6,308,415 B1 * 10/2001 Sablatschan ..... B26B 19/06 30/224
6,658,740 B2 * 12/2003 Habben ..... B26B 19/06 30/210
6,959,495 B2 * 11/2005 Rudolph ..... A01G 3/053 30/223
6,973,855 B2 * 12/2005 Yanosaka ..... B26B 19/06 30/195
7,010,859 B2 * 3/2006 Laube ..... F01B 3/045 30/223
7,080,458 B2 * 7/2006 Andis ..... B26B 19/06 30/208
7,290,349 B1 * 11/2007 Carpenter ..... B26B 19/3846 30/200
7,841,091 B2 * 11/2010 Melton ..... B26B 19/3846 30/223
7,913,399 B2 * 3/2011 Lau ..... B26B 19/06 30/194
8,132,332 B2 * 3/2012 Tautscher ..... B26B 19/06 30/208
8,176,637 B2 * 5/2012 Fukutani ..... B26B 19/3846 30/200
8,186,064 B2 * 5/2012 Pragt ..... B26B 19/06 30/208
8,555,509 B2 * 10/2013 Pohl ..... B26B 19/06 30/43.92
8,769,828 B2 * 7/2014 Lau ..... B26B 19/06 30/208
8,806,757 B2 * 8/2014 Moseman ..... B26B 19/3846 30/208
8,850,707 B2 * 10/2014 Maichel ..... B26B 19/06 30/200
9,027,252 B2 * 5/2015 Moseman ..... B26B 19/3846 30/208
9,545,730 B2 * 1/2017 Sablatschan ..... B26B 19/06 30/208
2004/0187644 A1 9/2004 Peterlin
2006/0207105 A1 * 9/2006 Alvite ..... B26B 19/06 30/225
2009/0320296 A1 * 12/2009 Morisugi ..... B26B 19/3846 30/43.92
2012/0167395 A1 * 7/2012 Duffy ..... A01G 3/053 30/223
2014/0115901 A1 * 5/2014 Liao ..... B26B 19/06 30/208
2014/0311306 A1 * 10/2014 Sablatschan ..... B26B 19/3846 30/223
2015/0328785 A1 * 11/2015 Sablatschan ..... B26B 19/06 30/224
2016/0101530 A1 4/2016 Sablatschan

FOREIGN PATENT DOCUMENTS

EP 1354674 A1 10/2003
EP 1894685 A1 3/2008
EP 3003654 B1 * 10/2017 ..... B26B 19/3846
JP 53017462 A * 2/1978
WO WO 2014191867 A1 * 12/2014 ..... B26B 19/3846

* cited by examiner

STATIONARY CUTTING BLADE FOR A HAIR CLIPPING DEVICE

This application is the U.S. National Phase application under 35 U.S.C. § 371 of International Application No. PCT/IB2014/061525 filed on May 19, 2014 which claims the benefit of European Application No. 13169845.8 filed on May 30, 2013. These applications are hereby incorporated by reference herein.

FIELD OF THE INVENTION

The present invention relates to a stationary cutting blade for a hair clipping device. Further, the present invention relates to a cutting assembly and a hair clipping device, in which such a stationary cutting blade is used. Even further, the present invention relates to a process for manufacturing such a stationary cutting blade.

BACKGROUND OF THE INVENTION

Electric hair cutting appliances are generally known and include trimmers, clippers and shavers whether powered by main supplied electricity or batteries. Such devices are generally used to trim body hair, in particular facial and head hair to allow a person to have a well-groomed appearance. These devices can, of course, also be used to trim pet hair or any other type of hair.

Conventional hair cutting devices comprise a main body forming an elongate housing having a front or cutting end and an opposite handle end. A cutting blade assembly is disposed at the cutting end. The cutting blade assembly usually comprises a stationary cutting blade and a movable cutting blade. The movable cutting blade moves in a reciprocal, translatory manner relative to the stationary cutting blade. The cutting blade assembly itself extends from the cutting end and is usually fixed in a single position relative to the main body of the hair clipper, such that the orientation of the cutting blade assembly is determined by a user orientating the main body of the device.

In common cutting blade units the cutting force driving the movable cutting blade is usually transmitted through a motor-driven eccentric. This eccentric is driven by an electric motor in a rotary manner. The rotary movement of the eccentric is then translated via a so-called driving bridge, which is connected to the movable cutting blade, into the resulting reciprocal, translatory movement of the movable cutting blade.

A common problem that occurs in such hair clipping devices is the so-called pulling effect. The pulling effect is an unwanted lifting of the movable cutting blade from the stationary cutting blade, which may especially occur during heavy load hair cutting. A reason for this pulling effect is the occurrence of a torque or twisting action on the movable cutting blade that may cause a tilt of the movable cutting blade. The evenness of the stationary and the movable cutting blade has a strong influence on the redoubtable pulling effect. It is therefore desired that the top surfaces of the cutting blades are as even as possible.

A lot of prior art hair clipping devices try to overcome this pulling effect by applying a very strong spring, which presses the two cutting blades against each other. The force applied by the spring shall impede a lifting or tilting of the movable cutting blade. The spring force is also used to compensate for manufacturing-related warpages within the cutting blades.

However, if the pressure between the stationary cutting blade and the movable cutting blade is increased, the friction between the two cutting blades will be increased as well. This increased friction often makes oiling necessary. Besides that it increases the abrasion of the two cutting blades. The increased friction also requires the appliance of an enlarged electric motor. Such an enlarged electric motor is on one hand expensive and on the other hand also voluminous. It increases the overall size of the hair clipping device as well as it increases the production costs. Apart from that, the power consumption of such enlarged electric motors is also higher than for hair clipping devices using smaller electric motors. This is especially disadvantageous for battery-driven hair clipping devices which in turn have shorter operating times.

Another approach for minimizing the risk for the pulling effect and improving the hair cutting performance is to provide cutting blades with sharper cutting edges. The cutting blades are usually provided with a plurality of teeth that act as a kind of scissor for cutting the hairs. The teeth geometry therefore plays an important role. Many prior art devices focus on an improvement of the teeth geometry of the movable cutting blade. However, also the teeth geometry of the stationary cutting blade, which is also denoted as guard, is of utmost importance.

Injection die casting processes allow to fabricate any desired teeth geometry with a synthetic material. Injection die casting is, however, a very cost-intensive manufacturing process.

Most of the prior art trimmer guard elements are made of metal, both for performance reasons and consumer appeal considerations. It is evident that metal guards have a longer lifetime compared to guards made from synthetic materials. Also their mechanical stiffness is higher. Nevertheless, these metal guards are more difficult to manufacture. Especially when thick metal guards having a thickness of more than one millimeter are used, creating precise and sharp teeth geometries becomes fairly difficult.

The state of the art manufacturing process for creating the teeth geometry of such metal guards is usually based on milling or grinding. In case of grinding, this is done by means of a regular grinding wheel with which the teeth are grinded tooth by tooth. This is, however, a very labor-intensive process. It has also been shown that the freedom of creating any desired teeth geometry is quite limited when using this grinding process.

FIGS. 8 and 9 show two examples of prior art stationary cutting blades (guards) with grinded teeth. These examples show that grinding the teeth of the stationary cutting blade limits the freedom in creating so-called scissor angles $\alpha$ in combination with sharp wedge angles $\gamma$. These angles are schematically illustrated in the figures, either in a top view (FIGS. 8*a* and 9*a*) or in a sectional view (FIGS. 8*b* and 9*b*). The scissor angle $\alpha$ is the angle with which the cutting edge of a tooth is inclined with respect to a vertical plane that is parallel to the longitudinal axis of the cutting tooth (see FIGS. 8*a* and 9*a*). The wedge angle $\gamma$ is the angle between a lateral face and the top face of a tooth (illustrated in the cross sections A-A and B-B in FIGS. 8*b* and 9*b*). The scissor angle $\alpha$ is mainly important for the ability of the teeth to limit the amount of simultaneous cutting of hair in order to prevent an overload under heavy load conditions. Compared to completely straight teeth with a scissor angle $\alpha$ of 0°, slightly inclined teeth with a scissor angle $\alpha>0°$ show a better cutting performance. The wedge angle $\gamma$ also plays a decisive role for the cutting performance to be achieved. A relatively small wedge angle $\gamma$ leads to a very sharp cutting edge having an increased cutting performance with less required force. However a too small wedge angle γ (too sharp cutting edge) might lead to a mechanically instable tooth which is too sensitive for breaking.

The examples given in FIGS. 8 and 9 also show that the thickness of the guard material also limits the freedom of shape, meaning that the thicker the guard becomes, the more difficult it is to create a desired teeth geometry.

What can be seen from FIGS. 8 and 9 is the automatic dependency between these two angles α and γ which results from the grinding process that is usually used to manufacture the teeth. In the example shown in FIG. 8 the scissor angle α is fairly small or almost zero. This however results in a very large wedge angle γ near 90°, which leads to a quite unsharp cutting edge. However, by trying to sharpen the cutting edge, i.e. decreasing the wedge angle γ to about 45°, as this has been done in the example shown in FIG. 9, it is unavoidable that this also results in a relatively large scissor angle α of about 30°.

Creating a smaller scissor angle α while still keeping the wedge angle γ at a value of around 45° is not possible when manufacturing the teeth by means of a grinding tool. This results from the fact that a grinding tool usually follows a fixed geometrical logic with limited freedom. This means that when creating a small scissor angle α, a sharp wedge angle γ cannot be created with the grinding tool. Instead, when creating a sharp wedge angle γ, for example by a diamond dressed grinding wheel, a small scissor angle α cannot be manufactured.

The teeth geometry in grinded metal guards is therefore always a suboptimal tradeoff. This is especially the case for full metal guards with a thickness of more than one millimeter. These full metal guards however show a very good heat dissipation behavior due to their thick material and are therefore desirable.

SUMMARY OF THE INVENTION

It is therefore an object of the present invention to provide an improved stationary cutting blade for a hair clipping device which overcomes the above-mentioned disadvantages of the state of the art. In particular, it is an object to provide a stationary cutting blade with a teeth geometry that enables an improved cutting performance and prevents the problematic pulling effect. It is a further object of the present invention to provide an improved process for manufacturing such a stationary cutting blade.

According to a first aspect of the present invention, the above-mentioned problem is solved by a stationary cutting blade for a hair clipping device, comprising:

a base body; and a plurality of coined cutting teeth which are spaced apart from each other and arranged on a front side of the base body and each extend parallel to a longitudinal axis of the stationary cutting blade;

wherein the stationary cutting blade is a full metal cutting blade and the base body has a first thickness measured between a top side and a bottom side of the base body along a transverse axis perpendicular to the longitudinal axis, wherein the cutting teeth have a second thickness measured parallel to the transverse axis, and wherein a thickness ratio between the first and the second thickness is larger than 1.1;

wherein each of the plurality of cutting teeth has a substantially wedge-shaped cross-section with a top face, a bottom face and two opposing lateral faces running in between the top and the bottom face;

wherein a cutting edge that is defined at the intersection between the top face and an upper section of one of the lateral faces has a scissor angle, which is defined between the cutting edge and an imaginary plane that is parallel to the longitudinal axis and the transverse axis and is perpendicular to the top face, and a wedge angle, which is defined between said upper section of the one of the lateral faces and the top face;

wherein a sum of the scissor angle and the wedge angle is smaller than 70°.

According to a second aspect, the problem is solved by a process for manufacturing a stationary cutting blade for a hair clipping device, comprising the steps of:

providing a piece of metal having a first thickness that serves as raw material;

creating a tapered shape into the piece of metal to create a rough shape of a tip of the stationary cutting blade;

stamping a preliminary teeth geometry into the tip to create a plurality of spaced-apart cutting teeth having a second thickness ($t_2$) measured in parallel to the first thickness ($t_1$), such that a thickness ratio between the first and the second thickness ($t_1/t_2$) is larger than 1.1;

coining the final teeth geometry by means of a coining die to form teeth with a substantially wedge-shaped cross-section, a top face, a bottom face and two opposing lateral faces running in between the top and the bottom face, and to simultaneously form a cutting edge at the intersection between the top face and an upper section of one of the lateral faces, wherein at the cutting edge a scissor angle is created, which is defined between the cutting edge and an imaginary plane that is parallel to a longitudinal axis and a transverse axis of the stationary cutting blade and is perpendicular to the top face, and a wedge angle is created, which is defined between said upper section of the one of the lateral faces and the top face;

wherein a sum of the scissor angle and the wedge angle is smaller than 70°.

According to a still further aspect, there is provided a cutting assembly for a hair clipping device comprising the above-mentioned stationary cutting blade and a movable cutting blade that is resiliently biased against the stationary cutting blade.

Still further, there is provided a hair clipping device comprising the latter mentioned cutting assembly and an actuator for moving the movable cutting blade relative to the stationary cutting blade in a reciprocal manner.

Preferred embodiments of the invention are defined in the dependent claims. It shall be understood that the claimed cutting assembly, the claimed hair clipping device and the claimed process for manufacturing the stationary cutting blade have similar and/or identical preferred embodiments as the claimed stationary cutting blade and as defined in the dependent claims.

One of the major insights of the present invention is that by coining the cutting teeth, the freedom of creating any desired teeth geometry is, compared to the regular grinding process, significantly increased. Coining the cutting teeth especially increases the freedom to create any desired scissor angle α almost independent of the wedge angle γ. The above-mentioned dependency between the scissor angle α and the wedge angle γ, which occurs when grinding the cutting teeth, does no longer exist. With the coining process there is no limit in creating scissor angles α in combination with sharp wedge angles γ. The invention describes a full metal stationary cutting blade and a unique possibility to get a coined teeth geometry even in a thick metal blade. According to an embodiment this thick metal blade may have a thickness of more than 1.3 mm. Coined cutting teeth allow an almost unlimited combination of wedge and scissor angles γ, α even with an extremely thick coil material.

With the above-mentioned coining process it is possible to manufacture cutting teeth of the stationary cutting blade, wherein a sum of the scissor angle α and the wedge angle γ is smaller than 70°. This has not been possible before with grinding (see reasons mentioned above). The invention therefore allows to produce a perfect sharp wedge angle γ which is combined with a desired scissor angle α.

It shall be understood that the term "coined cutting teeth" does not mean that pre-processing steps that are used to manufacture the cutting teeth may not include other manufacturing techniques, but only that the final teeth geometry is created by coining. In order to manufacture the cutting teeth a tapered shape is first created into the base body of the stationary cutting blade in order to create a rough shape of the tip of the stationary cutting blade. By this the thickness of the material is reduced at the tip such that the ratio between the thickness of the base body and the thickness of the cutting teeth is larger than 1.1. After this thickness reduction, the final teeth geometry may be created by coining. This allows to create an almost free-of-choice geometry of the cutting teeth. Without reducing the thickness at the tip of the stationary cutting blade, the teeth geometry could only be coined when using thin stationary cutting blades. Especially stationary cutting blades having a thickness of more 1.3 mm could not be coined without the said thickness reduction at the tip. At least the above-mentioned angle ranges for the scissor angle α and the wedge angle γ could most probably not created by coining.

Cutting units with a stationary cutting blade according to the present invention show a significantly improved hair cutting performance, wherein even with extremely tight hairs and an extreme quantity of hairs a perfect haircut is still guaranteed without the risk of the unwanted pulling effect. Apart from that, the stationary cutting blade according to the present invention with coined cutting teeth is also easier and cheaper to produce than by using the state of the art grinding process. The invention therefore allows to get a best functionality from the teeth in an easy way to manufacture combined with the full metal look and the best skin comfort.

According to a preferred embodiment the realized scissor angle α is smaller than 25° and the realized wedge angle γ is at the same time smaller than 55°. Such an angle combination in experiments of the applicant has shown to result in a very good cutting performance even under heavy load conditions. It shall be highlighted again that such an angle combination is unique and would not have been possible before for cutting teeth of thick metal stationary cutting blades that are usually manufactured by grinding.

Experiments of the applicant have shown that especially a combination of the scissor angle α between 5° and 25° and the wedge angle γ between 40° and 55° results in the best possible teeth functionality. Most preferably, the wedge angle γ is chosen to be around 45° or equal to 45°, whereas the scissor angle α is chosen to be around 12° or equal to 12°.

According to a preferred embodiment, each of the plurality of cutting teeth has exactly two of said cutting edges, wherein each of the two cutting edges is a substantially straight cutting edge.

"Substantially straight" in this sense shall mean that there is no step in the cutting edge. It may however slightly be curved. Straight, linear cutting edges are easy to manufacture by the proposed coining process and also show a good cutting performance.

According to a further preferred embodiment of the present invention, each of the plurality of cutting teeth is symmetrical and comprises two identical opposing lateral faces, wherein each of the two lateral faces comprises an upper section and a lower section that is inclined with respect to the upper section and arranged locally in between the upper section and the bottom face, wherein a distance between the two upper sections of each cutting tooth is larger than a distance between the two lower sections of each cutting tooth.

This means that the top face of the stationary cutting blade has a larger lateral dimension than the bottom face. The top face of the stationary cutting blade is also called working surface as this is usually the side that faces towards the movable cutting blade in a cutting assembly of a hair clipping device. The larger top face does not only increase the mechanical stability of each cutting tooth, but also increases the skin comfort when using the presented stationary cutting blade in a hair clipping device, e.g. for beard trimming.

According to a further embodiment, an angle between the top face and each of the lower sections of the lateral faces is larger than the wedge angle γ. In other words this means that the lower portions of the lateral faces of the cutting teeth are stronger inclined with respect to the top face than the upper portions of the lateral faces. Each lateral face is thus not a straight wall, but has a kind of step or sharp bend in it thus having a kind of step form or echelon form. This enables to realize a relatively small wedge angle y of around 45°, while still having a mechanically stable structure at the lower (thinner) portions of each cutting tooth.

As stated in the opening paragraph above, the present invention also relates to the process for manufacturing the above-mentioned stationary cutting blade.

According to an embodiment, this process comprises the steps of:

- providing a piece of metal having a thickness of more than one millimeter that serves as raw material;
- creating a tapered shape into the piece of metal to create a rough shape of a tip of the stationary cutting blade;
- stamping a preliminary teeth geometry into the tip to create a plurality of spaced-apart cutting teeth; and
- coining the final teeth geometry by means of a coining die.

According to an embodiment, before coining the wedge into the piece of metal, the process further comprises the step of:

- stamping a recess into said piece of metal at a position where the tip of the stationary cutting blade is to be created.

Preferably, during coining the final teeth geometry by means of the coining die, a scissor angle α of between 5° and 25° is formed. Also preferably, during coining the final teeth geometry by means of the coining die, a wedge angle γ between 40° and 55° is formed.

BRIEF DESCRIPTION OF THE DRAWINGS

These and other aspects of the invention will be apparent from and elucidated with reference to the embodiment(s) described hereinafter. In the following drawings

DETAILED DESCRIPTION OF THE INVENTION

Figure 1:
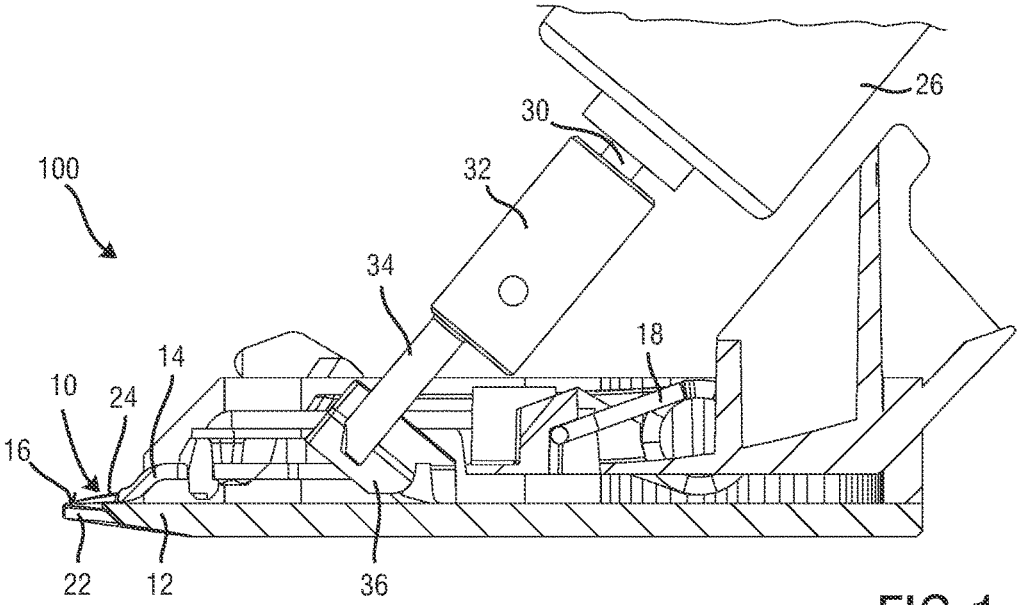
FIG. 1 shows a sectional view of parts of a hair clipping device with a stationary cutting blade according to the present invention.
Figure 2:
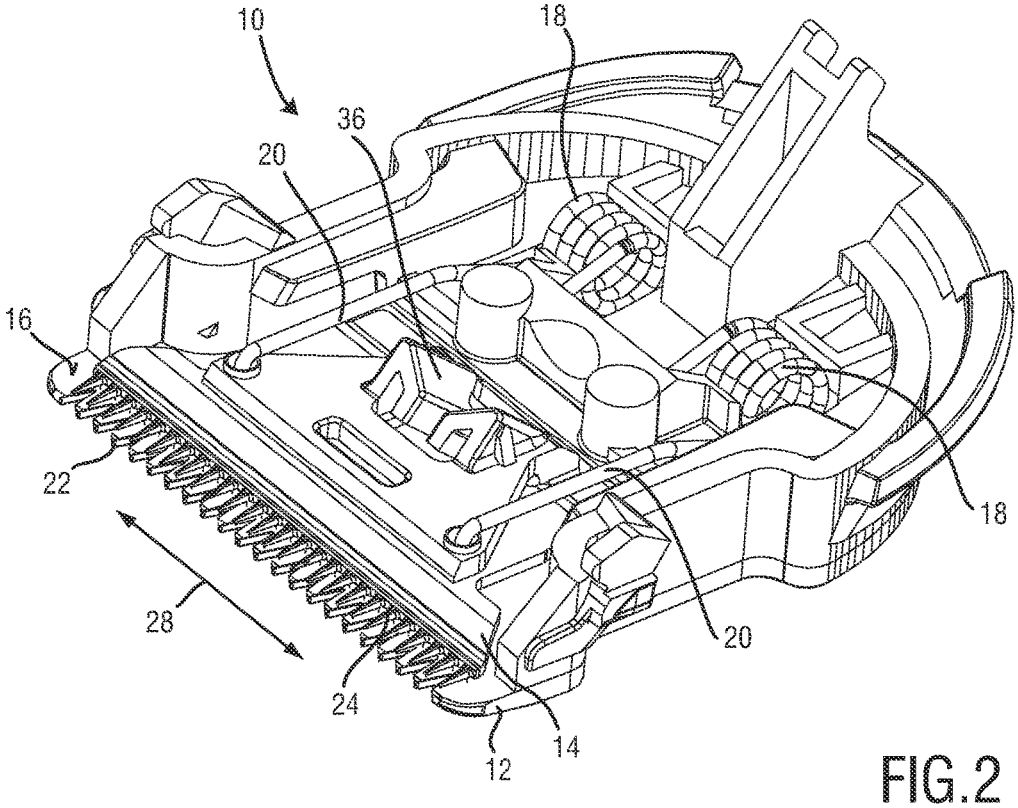
FIG. 2 shows a perspective view of an embodiment of a cutting unit according to the present invention.

FIGS. 1 and 2 schematically illustrate an example of a hair clipping device and a cutting unit in which a stationary cutting blade according to the present invention may be used. The hair clipping device is therein in its entirety denoted with reference numeral 100.

The hair clipping device 100 usually comprises a housing (not explicitly shown) in which all remaining parts are usually integrated. The housing also serves as a holder for a cutting assembly 10 (see FIG. 2). The housing usually has an elongated body, wherein the cutting assembly 10 is releasably fixed to a front end of said housing. The cutting assembly 10 may of course also be permanently fixed to the front end of the housing. The housing may further comprise a handle at its rear end (not shown).

The cutting assembly 10 includes a stationary cutting blade 12 and a movable cutting blade 14. The movable cutting blade 14 is displaceably mounted on a top side 16 of the stationary cutting blade 12, which top side 16 faces substantially towards the inner side of the housing. By the help of a spring 18, the movable cutting blade 14 is resiliently biased against the stationary cutting blade 12. The spring 18 may be realized as a mechanical spring that comprises two spring levers 20. These spring levers 20 exert a spring force onto the movable cutting blade 14 in order to keep the two cutting blades 12, 14 close together.

The stationary cutting blade 12 comprises a plurality of cutting teeth 22 at its free front end. In this example the movable cutting blade 14 also comprises an array of cutting teeth 24. However, it could generally also comprise a continuous sharp edge instead of the array of cutting teeth 24. During operation haircutting is performed by the interaction of the stationary cutting blade 12 and the movable cutting blade 14 that reciprocates on the stationary cutting blade 12, as this is known from other conventional hair clipping devices.

A drive arrangement including a motor 26 is adapted to drive the movable cutting blade 14 in an oscillatory manner in an opposing movement direction 28. The motor 26 thereto comprises a rotary driven shaft 30 that is forced into rotation. An eccentric transmission element 32 including an eccentric pin 34 protruding therefrom is arranged on said rotary-driven shaft 30. The eccentric transmission element 32 may be clamped onto the shaft 30 or coupled to it in another way. However, the shaft 30 and the eccentric transmission element 32 may also be realized as one integrated part. The motor 26 may, for example, be realized as an electric motor that is either powered by main supplied electricity or battery-driven.

The rotary movement of the eccentric transmission element 32 is translated into the translatory movement of the movable cutting blade 14 via a coupling element 36. The coupling element 36 is also called "driving bridge".

The stationary cutting blade 12 is usually designed to be thicker than the movable cutting blade 14. Said stationary cutting blade 12 is also denoted as "guard". The guard 12 is according to the present invention realized as a full metal guard (fully made of metal). It comprises a base body 48, wherein the cutting teeth 22 are arranged at a front part (also referred to as "tip") of the base body 48 (see FIG. 3). The thickness $t_1$ of the base body 48 is preferably chosen to be larger than 1.3 mm. Such thick guards 12 serve for an optimal mechanical stability. Thick metal guards 12 like these also have a very good heat dissipation behavior, which is quite important, since the guard 12 should not heat up too much in order to reduce the risk for a user to get burned.

Such thick full metal guards 12 are, however, more difficult to manufacture. Especially the teeth geometry is very difficult to manufacture. Common thick full metal guards are manufactured exclusively with a process wherein the cutting teeth are grinded. This grinding process is quite time-consuming and therefore costly. Apart from that, grinding also has some geometrical limitations. Teeth geometries that may be established with the state of the art grinding process are quite limited. It is hardly possible to create specific combinations of scissor angles $\alpha$ and wedge angles $\gamma$ within the teeth. Only certain combinations are possible. The reason for that is the dressing of the grinding wheel that follows a fixed geometrical logic. Grinding the cutting teeth therefore usually results in a fixed dependency between the so-called scissor and wedge angle (see below).

The inventors of the present invention have now found that the teeth geometry of the stationary cutting blade 12 may also be manufactured in a coining process even if it is a thick full metal guard with a base body 48 that might have a thickness $t_1$ of more than one millimeter. The front part of the stationary cutting blade 12 is thereto designed to be thinner than the base body 48. A ratio between the thickness $t_1$ of the base body 48 and the thickness $t_2$ of the cutting teeth 22 is chosen to be larger than 1.1. The reduced thickness $t_2$ of the cutting teeth 22 allows to manufacture the teeth geometry in a very accurate coining process. With the coining process there is no longer a limit in creating scissor angles $\alpha$ in combination with any desired sharp wedge angle $\gamma$. It is therefore possible to create new and unique teeth geometries which would not be possible with the common grinding technique.

It shall be understood that the thickness $t_2$ of the cutting teeth 22 denotes the dimension of the cutting teeth 22 measured in parallel to the transverse axis 42 of the stationary cutting blade 12 at the thickest point (rear end) of the cutting teeth 22.

FIGS. 3 to 6 show the new design of the stationary cutting blade 12, wherein the focus is on the new geometry of the cutting teeth 22.

Figure 3A:
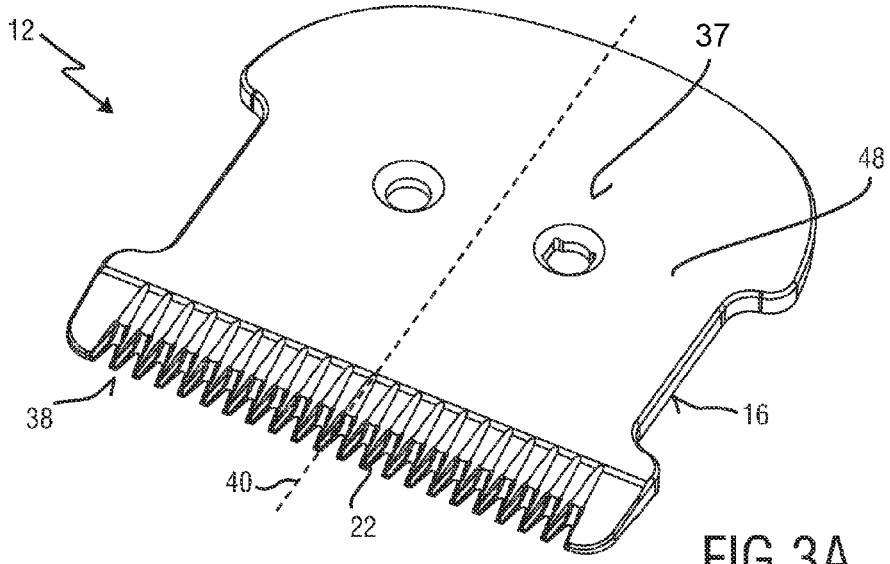
FIGS. 3A and 3B show perspective and sectional views of an embodiment of the stationary cutting blade according to the present invention.
Figure 3B:
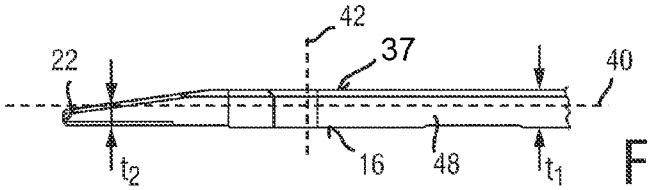

FIG. 3A shows a perspective view of the stationary cutting blade 12 and FIG. 3B shows a sectional view of the stationary cutting blade 12 according to the present invention. It shall be noted that the stationary cutting blade 12 is in these figures shown with its bottom side 37 facing upwards. When fixed in the cutting assembly 10, it is compared to these figures turned round.

The base body 48 of the stationary cutting blade 12 comprises a top side 16 that is usually pressed against the lower side of the movable cutting blade 14. The bottom side 37 runs substantially parallel thereto. The plurality of coined cutting teeth 22 are arranged on the front side 38 of the stationary cutting blade 12. A longitudinal axis of each cutting teeth 22 extends parallel to a longitudinal axis 40 of the stationary cutting blade 12.

Figure 4:
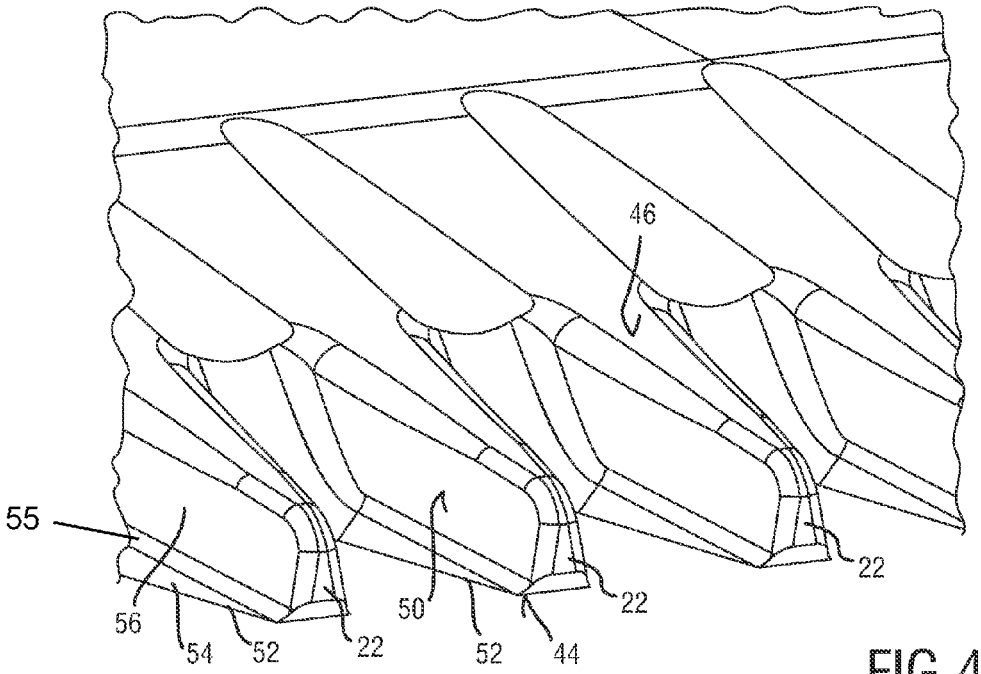
FIG. 4 shows an enlarged view of the teeth of the stationary cutting blade according to the present invention.
Figure 5:
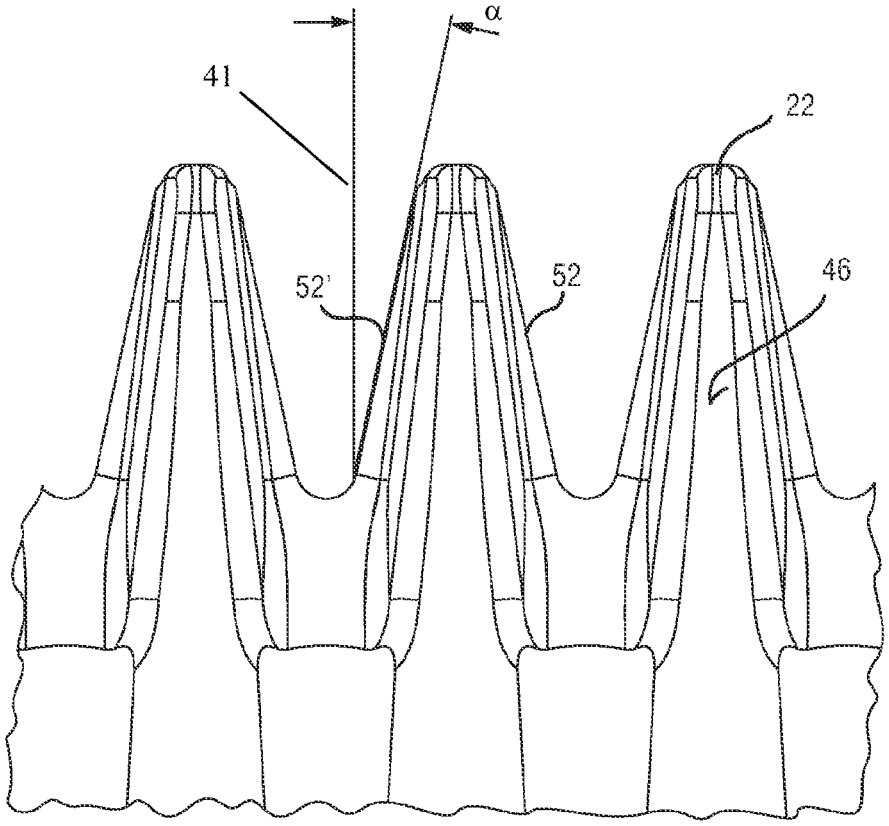
FIG. 5 shows a top view of the teeth of the stationary cutting blade according to the present invention.
Figure 6:
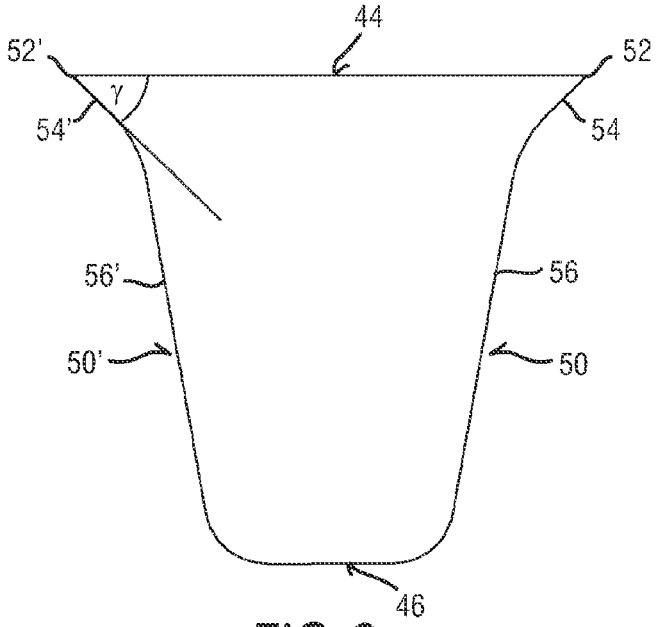
FIG. 6 shows a schematic cross section of a tooth of the stationary cutting blade according to the present invention.
Figure 7A:
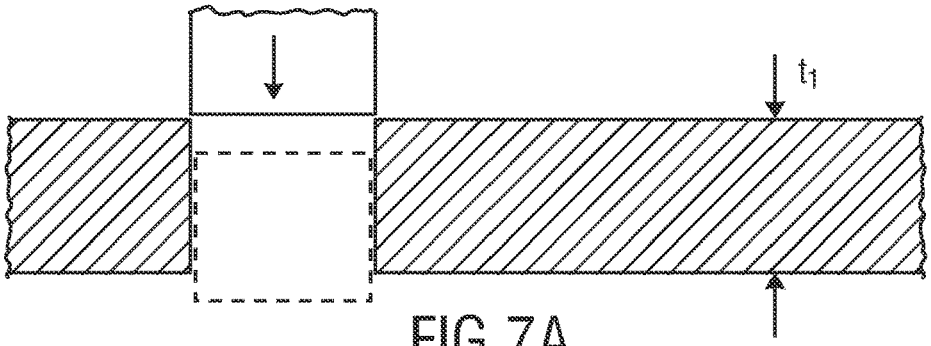
FIGS. 7A-7D show schematically illustrate a manufacturing process of the stationary cutting blade according to the present invention.
Figure 7B:
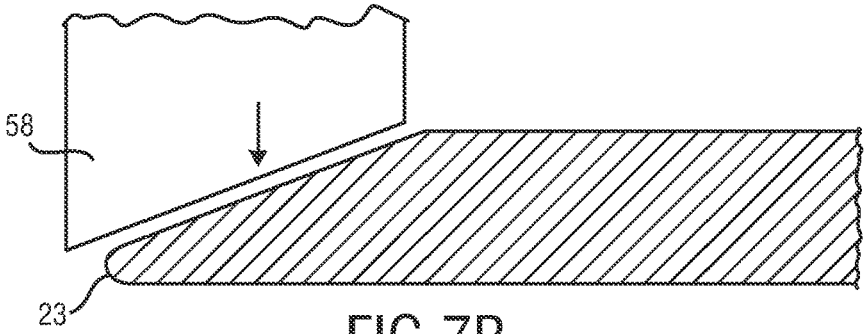
Figure 7C:
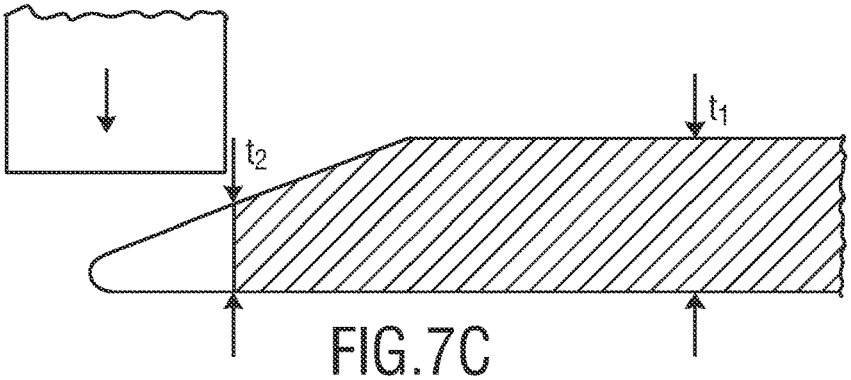
Figure 7D:
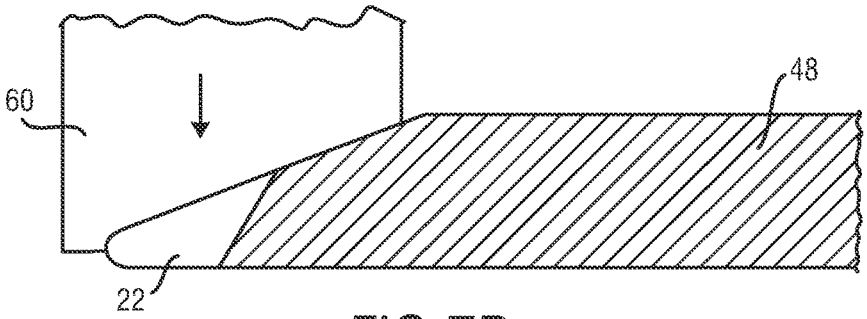

The teeth geometry of the cutting teeth 22 may be best seen in FIGS. 4 to 6. Each cutting tooth 22 has a substantially wedge-shaped cross section with a top face 44, a bottom face 46 and two opposing lateral faces 50, 50' running in between the top and the bottom face 44, 46. Each cutting tooth 22 comprises two cutting edges 52, 52' that are arranged at the intersection between the top face 44 and an upper section 54, 54' of one of the lateral faces 50, 50'. Each lateral face 50, 50' also comprises a lower section 56, 56' which is inclined with respect to the upper section 54, 54' of the respective lateral face 50, 50'. Each lateral face 50, 50' therefore has sharp bend(s) in it, a kind of step form or echelon form. Such a shape would hardly be possible with the state of the art grinding process. With the presented new coining process it is however easy to manufacture. As shown in FIGS. 4 and 6, the front of a tooth has a kind of a 2-step form while the back of the tooth has a kind of a 3-step form (FIG. 4), including the lower section 56, the upper section 54 and an intermediate section 55 between the lower and upper sections 56, 54.

Figure 8A:
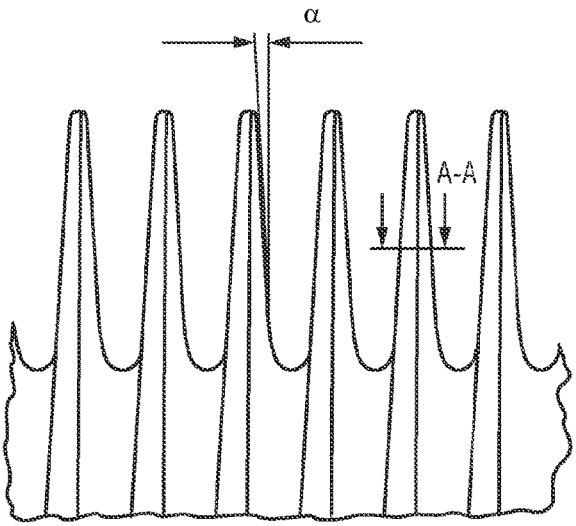
FIG.8A Prior Art
FIGS. 8A and 8B show a first example of a stationary cutting blade according to the prior art.
Figure 8B:
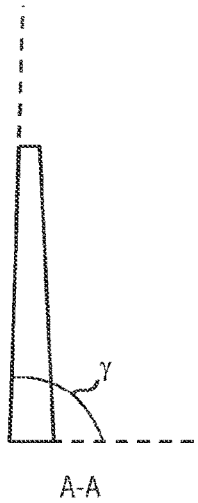
FIG.8B Prior Art
Figure 9A:
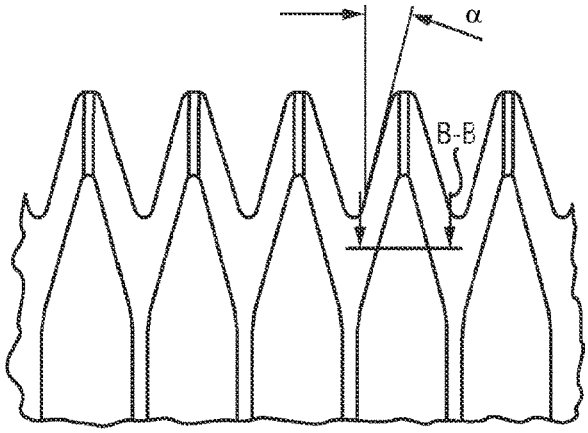
FIG.9A Prior Art
FIGS. 9A and 9B show a second example of a stationary cutting blade according to the prior art.
Figure 9B:
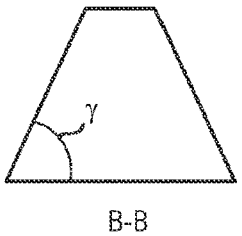
FIG.9B Prior Art

By coining the cutting teeth 22 it is possible to freely design the scissor angle $\alpha$ and the wedge angle $\gamma$ independent from each other. As shown in FIG. 5, the scissor angle $\alpha$ is defined between each cutting edge 52, 52' and an imaginary plane 41 that is parallel to the longitudinal axis 40 of the stationary cutting blade 12. That is, the scissor angle $\alpha$ is defined between a cutting edge 52' and the longitudinal tooth axis, which is parallel to the imaginary plane 41. Said scissor angle $\alpha$ is important for the ability of the teeth 22 to limit the amount of simultaneous cutting of hair in order to prevent an overload under heavy load conditions. Compared to completely straight teeth with a scissor angle of 0° (as e.g. in the prior art example shown in FIG. 8) slightly inclined teeth 22 show a better cutting performance.

According to the present invention, this scissor angle $\alpha$ is preferably chosen to be smaller than 25°. More preferably, it is chosen to be between 5° and 25°. Most preferably, the scissor angle $\alpha$ is around or equal to 12°.

As best shown in FIG. 6, the coining process at the same time allows to create fairly sharp cutting edges 52, 52' by having a comparatively small wedge angle $\gamma$. The smaller this wedge angle $\gamma$ is, the sharper the cutting edge 52, 52' gets. However, a too small wedge angle $\gamma$ would result in a mechanically instable and too sensitive cutting edge 52, 52'. It has therefore been found by experiments of the applicant that an optimal range for the wedge angle $\gamma$ is between 40° and 55°. Most preferably, this wedge angle $\gamma$ is around or equal to 45°. Again it shall be noted that the cross section as shown in FIG. 6 would not be possible with the regular grinding technique. A combination of a scissor angle $\alpha$ around 12° combined with a wedge angle $\gamma$ around 45° is therefore unique. Hair cut tests of the applicant have shown that hair clipping devices equipped with the stationary cutting blade 12 according to the present invention show a very good hair cutting performance. Especially under extreme tight and thick hairs the new stationary cutting blade 12 with the new teeth geometry showed an almost perfect cutting behavior, wherein there is almost no risk for the unwanted pulling effect.

FIG. 7 schematically illustrates the manufacturing process of the stationary cutting blade 12 according to the present invention. In a first step (see FIG. 7A) a metal coil having a thickness $t_1$ of more than one millimeter is trimmed in order to receive separate metal pieces from which the guard 12 may be manufactured. This is usually done by stamping a recess into the metal coil material at a position where the tip 23 of the cutting teeth 22 shall be created. In the next step (see FIG. 7B), a tapered shape will be created at the tip of the guard. This may be done either by removing the metal material or by deforming it. Several techniques are thereto generally conceivable, e.g. milling, grinding, forging, abrading, etc. According to a preferred embodiment, this is done by coining using a coining wedge that is schematically illustrated in FIG. 7B and indicated by reference numeral 58. This process step is used to create a rough shape of the tip of the stationary cutting blade 12.A further benefit of this step is that the thickness of the metal is decreased to $t_2$ at the position where the cutting teeth will be created. This facilitates the following coining process that is used to create the final teeth geometry.

In the third step (see FIG. 7C) the teeth geometry including the excess material from the wedge cold forming process will be stamped out. In this step, the preliminary teeth geometry will be stamped into the tip to create a plurality of spaced-apart cutting teeth. Finally, in a fourth third step (see FIG. 7D), the teeth geometry will be cold formed with a coining process by means of a coining die 60. This is usually done for all cutting teeth in parallel. The coining die 60 thereto has the negative of the teeth geometry that shall be created. In this process step the above-mentioned angles $\alpha$ and $\beta$ are created.

In order to receive a completely flat top side 16 of the guard 12, the top side 16 may be finally polished or flat-grinded (not shown).

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage.

Any reference signs in the claims should not be construed as limiting the scope.

The invention claimed is:

1. A stationary cutting blade for a hair clipping device, comprising:

a base body defining a body longitudinal axis and a transverse axis perpendicular to the body longitudinal axis; and a plurality of spaced apart cutting teeth arranged on a front side of the base body, wherein each of the cutting teeth has at least one cutting edge and defines a tooth longitudinal axis which is parallel to the body longitudinal axis;

wherein the stationary cutting blade is a metal cutting blade and the base body has a first thickness, said first thickness being measured between a top side and a bottom side of the base body along the transverse axis, wherein the cutting teeth have a second thickness measured parallel to the transverse axis, wherein a thickness ratio between the first thickness and the second thickness is larger than 1.1, wherein each of the cutting teeth has a substantially wedge-shaped cross-section with a top face, a bottom face and two opposing lateral faces running in between the top and the bottom face, each of the two opposing lateral faces having a first sharp bend between an upper section and an intermediate section which is inclined with respect to the upper section, and a second sharp bend between the intermediate section and a lower section which is inclined with respect to the intermediate section, wherein the at least one cutting edge is defined at an intersection between the top face and the upper section of one of the two opposing lateral faces and has a scissor angle and a wedge angle, the scissor angle being defined between the at least one cutting edge and the tooth longitudinal axis, and the wedge angle being defined between said upper section of the one of the lateral faces and the top face, and wherein a sum of the scissor angle and the wedge angle is smaller than 70°.

2. The stationary cutting blade according to claim 1, wherein the scissor angle is smaller than 25°.

3. The stationary cutting blade according to claim 1, wherein the wedge angle is smaller than 55°.

4. The stationary cutting blade according to claim 1, wherein the scissor angle is between 5° and 25°.

5. The stationary cutting blade according to claim 1, wherein the wedge angle is between 40° and 55°.

6. The stationary cutting blade according to claim 1, wherein the first thickness is larger than 1.3 mm.

7. The stationary cutting blade according to claim 1, wherein the at least one cutting edge is exactly two cutting edges and wherein each of the two cutting edges is substantially straight.

8. The stationary cutting blade according to claim 1, wherein each of the plurality of cutting teeth is symmetrical, wherein a distance between a portion of two of the upper sections of the two opposing lateral faces of the each of the cutting teeth near the top face is larger than a distance between two of the lower sections of the two opposing lateral faces near the bottom face.

9. The stationary cutting blade according to claim 8, wherein an angle between the bottom face and each of the two lower sections of the two opposing lateral faces is larger than the wedge angle .

10. A cutting assembly for a hair clipping device, comprising:

a stationary cutting blade according to claim 1; and a moveable cutting blade that is resiliently biased against the stationary cutting blade by a spring.

11. A hair clipping device comprising a cutting assembly having stationary cutting blade and a moveable cutting blade, and an actuator for moving the moveable cutting blade relative to the stationary cutting blade in a reciprocal manner, where the stationary cutting blade comprises:

a base body defining a body longitudinal axis and a transverse axis perpendicular to the body longitudinal axis; and a plurality of spaced apart cutting teeth with arranged on a front side of the base body, wherein each tooth of the cutting teeth has at least one cutting edge and defines a tooth longitudinal axis, and extends along the tooth longitudinal axis which is parallel to the body longitudinal axis of the stationary cutting blade;

wherein the stationary cutting blade is a metal cutting blade and the base body has a first thickness, said first thickness being measured between a top side and a bottom side of the base body along the transverse axis, wherein the cutting teeth have a second thickness measured parallel to the transverse axis, wherein a thickness ratio between the first thickness and the second thickness is larger than 1.1, wherein each of the cutting teeth has a substantially wedge-shaped cross-section with a top face, a bottom face and two opposing lateral faces running in between the top and the bottom face, each of the two opposing lateral faces having a first sharp bend between an upper section and an intermediate section which is inclined with respect to the upper section, and a second sharp bend between the intermediate section and a lower section which is inclined with respect to the intermediate section, wherein the at least one cutting edge is defined at an intersection between the top face and the upper section of one of the two opposing lateral faces and has a scissor angle and a wedge angle, the scissor angle being defined between the at least one cutting edge and the tooth longitudinal axis, and the wedge angle being defined between said upper section of the one of the lateral faces and the top face, and wherein a sum of the scissor angle and the wedge angle is smaller than 70°.

12. A process for manufacturing a stationary cutting blade or a hair clipping device, comprising acts of:

providing a piece of metal having a first thickness that serves as raw material;

creating a tapered shape into the piece of metal in order to create a rough shape of a tip of the stationary cutting blade;

stamping a preliminary teeth geometry into the tip to create a plurality of spaced-apart cutting teeth having a second thickness measured in parallel to the first thickness, such that a thickness ratio between the first and the second thickness is larger than 1.1; and coining a final teeth geometry by means of a coining die to provide each tooth of the plurality of spaced-apart cutting teeth with a substantially wedge-shaped cross-section, a top face, a bottom face and two opposing lateral faces running in between the top and the bottom face and having inclined sections, and to simultaneously form a cutting edge at the intersection between the top face and one of an upper section of one of the lateral faces, wherein at the cutting edge a scissor angle is created, which is defined between the cutting edge and a longitudinal axis of the stationary cutting blade, and a wedge angle is created, which is defined between said upper section of the one of the lateral faces and the top face;

wherein the inclined sections of the two opposing lateral faces include a first sharp bend between the upper section and an intermediate section which is inclined with respect to the upper section, and a second sharp bend between the intermediate section and a lower section which is inclined with respect to the intermediate section, and wherein a sum of the scissor angle and the wedge angle is smaller than 70°.

13. The manufacturing process according to claim 12, wherein, before the coining act, the process further comprises an act of stamping into said piece of metal at a position where the tip of the stationary cutting blade is to be created.

14. The manufacturing process according to claim 12, wherein during the coining act a scissor angle of between 5° and 25° is formed.

15. The manufacturing process according to claim 12, wherein during the coining act a wedge angle between 40° and 55° is formed.

* * * * *